US010674889B2

(12) United States Patent
Boyer

(10) Patent No.: US 10,674,889 B2
(45) Date of Patent: Jun. 9, 2020

(54) DOCKING PORT ARRANGEMENT FOR AN ADJUSTABLE DISPENSING DEVICE

(71) Applicant: Midea Group Co., Ltd., Beijiao, Shunde, Foshan (CM)

(72) Inventor: Joel Boyer, Louisville, KY (US)

(73) Assignee: MIDEA GROUP CO., LTD., Beijiao, Shunde, Foshan (CN)

( * ) Notice: Subject to any disclaimer, the term of this patent is extended or adjusted under 35 U.S.C. 154(b) by 0 days.

(21) Appl. No.: 16/014,416

(22) Filed: Jun. 21, 2018

(65) Prior Publication Data

US 2019/0387953 A1 Dec. 26, 2019

(51) Int. Cl.
*A47L 15/23* (2006.01)
*A47L 15/50* (2006.01)

(52) U.S. Cl.
CPC ..... *A47L 15/508* (2013.01); *A47L 15/23* (2013.01); *A47L 15/504* (2013.01)

(58) Field of Classification Search
CPC ..... A47L 15/23
See application file for complete search history.

(56) References Cited

U.S. PATENT DOCUMENTS

| | | | |
|---|---|---|---|
| 5,823,211 | A | 10/1998 | Wilhelmstatter et al. |
| 6,431,188 | B1 | 8/2002 | Laszczewski, Jr. et al. |
| 6,869,029 | B2 | 3/2005 | Ochoa, Sr. et al. |
| 7,055,537 | B2 | 6/2006 | Elick et al. |
| 7,467,636 | B2 | 12/2008 | Welch |
| 7,789,968 | B2 | 9/2010 | Elick et al. |
| 8,900,375 | B2 | 12/2014 | Gnadinger et al. |
| 9,241,604 | B2 | 1/2016 | Dries |
| 9,480,389 | B2 | 11/2016 | Haft et al. |
| 9,687,137 | B2 | 6/2017 | Boyer et al. |
| 2006/0185700 | A1 | 8/2006 | Lee |
| 2008/0163904 | A1 | 7/2008 | Hwang |
| 2009/0090400 | A1 | 4/2009 | Burrows et al. |
| 2014/0196756 | A1 | 7/2014 | Dries |

FOREIGN PATENT DOCUMENTS

| | | | |
|---|---|---|---|
| CN | 1899196 | A | 1/2007 |
| CN | 102008276 | A | 4/2011 |
| CN | 102008277 | A | 4/2011 |
| CN | 202875277 | U | 4/2013 |
| CN | 105231971 | A | 1/2016 |
| CN | 107137039 | A | 9/2017 |
| WO | WO2017108072 | A1 | 6/2017 |

OTHER PUBLICATIONS

"Docking Station with Flappers" Whirlpool. www.partselect.com. Retrieved Jan. 8, 2018.
International Search Report and Written Opinion issued in Application No. PCT/CN2019/079642 dated Jul. 1, 2019.

*Primary Examiner* — Jason Y Ko
(74) *Attorney, Agent, or Firm* — Middleton Reutlinger

(57) ABSTRACT

A method and apparatus of a docking port arrangement for an adjustable dispensing device. The dispensing device may discharge a fluid and/or gas into the wash chamber. The dispensing device may be retracted into the wash chamber and extended out of the wash chamber. A gasket or portions thereof may be used for sealing and/or as an abutting structure during retraction into the wash chamber. The dispensing device may be, but is not limited to, a rotating spray arm. Two check valves may pivot together relative to a check valve plate.

16 Claims, 5 Drawing Sheets

DOCKING PORT ARRANGEMENT FOR AN ADJUSTABLE DISPENSING DEVICE

BACKGROUND

The present embodiments relate to an appliance having a fluid docking port arrangement for a movable rack, drawer, shelf, basket, etc. with particular embodiments shown for a dishwasher rack for a dish washing appliance.

Typical dishwasher racks are pulled out and pushed back into place within the dishwasher tub, with the rack riding on rollers, wheels, glides, or rails to fluidly engage and disengage a docking port from the water source. Occasionally, the seals of the docking port are not suitable for repeated compression. Moreover, engaging and/or disengaging from the docking port may generate undesirable noise and/or an undesirable feeling/touch perceived by the consumer. Thus, there is a need, but is not limited to, for the docking port arrangement to provide a repeatable seal and/or increase the consumer's positive perception of the engaging and/or disengaging operation.

SUMMARY

In some embodiments of the invention, an adjustable spray arm assembly may comprise a conduit having an upstream end and a downstream end. In various embodiments, the upstream end may define an opening. In some embodiments, the spray arm assembly may include a dispensing device adjacent to and in fluid communication with the downstream end of the conduit. In addition, in various embodiments, the spray arm assembly may include a check valve plate positioned at the opening of the upstream end of the conduit. In some embodiments, the check valve plate may include an upper aperture, a lower aperture, and two or more check valves operable between a closed position and an open position with the upper aperture and the lower aperture. In various embodiments, the spray arm assembly may include a gasket having an upper aperture aligned with the upper aperture of the check valve plate and a lower aperture aligned with the lower aperture of the check valve plate. Moreover, in some embodiments, the gasket includes one or more abutment members for an abutting engagement with an upstream docking station.

In various embodiments, the check valve plate may include an interior surface facing towards the opening of the upstream end and an opposing exterior surface, wherein the gasket may extend along the interior surface, through at least one of the upper aperture and the lower aperture of the check valve plate, and the exterior surface. In some embodiments, the gasket extending along the exterior surface may include the one or more abutment members. In various embodiments, the two or more check valves may include an upper check valve and a lower check valve pivotally connected to the check valve plate within the upstream end of the conduit. In addition, in some embodiments, the upper check valve and the lower check valve may be fixed at opposing ends of an arm, wherein the upper check valve and the lower check valve pivot together relative to the check valve plate. In some embodiments, the adjustable spray arm assembly may comprise an outer periphery, wherein the outer periphery includes the one or more abutment members of the gasket.

In some embodiments, an adjustable spray arm assembly for use in a dish washing appliance may comprise a wash chamber, a water supply conduit in fluid communication with a docking station, and an adjustable spray arm in fluid communication with the docking station in an retracted position and out of fluid communication with the docking station in an extended position. Moreover, in various embodiments, the docking station may be positioned within the wash chamber. In some embodiments, the adjustable spray arm comprises a conduit having an upstream end and a downstream end. Moreover, in various embodiments, the upstream end may define an opening. In some embodiments, the adjustable spray arm may include a dispensing device adjacent to and in fluid communication with the downstream end of the conduit. In various embodiments, the adjustable spray arm may include a check valve plate positioned at the opening of the upstream end of the conduit. In some embodiments, the check valve plate may include an upper aperture, a lower aperture, and two or more check valves operable between a closed position and an open position with the upper aperture and the lower aperture. Moreover, in various embodiments, the upper aperture and the lower aperture may be configured for selective receipt of the docking station when in the retracted position. In some embodiments, the adjustable spray arm may include a gasket having an upper aperture aligned with the upper aperture of the check valve plate and a lower aperture aligned with the lower aperture of the check valve plate. In various embodiments, the gasket may include one or more abutment members in contact with at least one of the water supply conduit and the docking station when in the retracted position. In addition, in some embodiments, the one or more abutment members may be out of contact with at least one of the water supply conduit and the docking station when in the extended position.

In various embodiments, the docking station may include a conical protrusion guiding the docking station into receipt of the upper aperture or the lower aperture of the check valve plate. In some embodiments, the one or more abutment members may contact a remaining portion of the docking station outwardly from the conical protrusion. In addition, in various embodiments, the check valve plate may include an interior surface facing towards the opening of the upstream end and an opposing exterior surface. In some embodiments, the gasket may extend along the interior surface, through at least one of the upper aperture and the lower aperture of the check valve plate, and the exterior surface. In various embodiments, the gasket extending along the exterior surface may include the one or more abutment members. In some embodiments, the two or more check valves may include an upper check valve and a lower check valve pivotally connected to the check valve plate within the upstream end of the conduit. In various embodiments, the upper check valve and the lower check valve may be fixed at opposing ends of an arm, wherein the upper check valve and the lower check valve may pivot together relative to the check valve plate. Moreover, in some embodiments, the gasket may be made of a silicone. In various embodiments, the dispensing device may be a rotating spray arm.

In addition, in various embodiments, a method of dampening the contact between an adjustable spray arm assembly and a docking station within a dish washing appliance may comprise the steps of providing a gasket for a plurality of apertures of a dock of an adjustable spray arm assembly. In some embodiments, the method may include retracting the adjustable spray arm assembly from an extended position to an operative position. In some embodiments, the method may include inserting a first portion of a docking station into sealing engagement with at least one of a plurality of apertures of the gasket. In some embodiments, the method may include abutting the gasket to a second portion of the docking station when in the operative position, wherein the second portion of the docking station is different from the first portion of the docking station.

In various embodiments, the method may further comprise the step of extending the adjustable spray arm assembly from the operative position to the extended position. In some embodiments, the method may include the gasket may be out of engagement with the second portion of the docking station when extending the adjustable spray arm assembly from the operative position to the extended position. In various embodiments, the method may include the step of adjusting the adjustable spray arm assembly vertically upward or downward relative to the docking station. In addition, in various embodiments, the dock may include an upper check valve and a lower check valve fixed together on opposing ends of a member. In some embodiments, the method may further comprise the step of pivoting each one of the upper check valve and the lower check valve together about a hinge to selectively open or close the plurality of apertures. In various embodiments, the step of inserting the first portion of the docking station with at least one of a plurality of apertures of the gasket occurs before the step of abutting the gasket to the second portion of the docking station.

These and other advantages and features, which characterize the embodiments, are set forth in the claims annexed hereto and form a further part hereof However, for a better understanding of the embodiments, and of the advantages and objectives attained through its use, reference should be made to the drawings and to the accompanying descriptive matter, in which there are described example embodiments. This summary is merely provided to introduce a selection of concepts that are further described below in the detailed description, and is not intended to identify key or essential features of the claimed subject matter, nor is it intended to be used to limit the scope of the claimed subject matter, nor to define the field of endeavor.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DETAILED DESCRIPTION

Figure 1:
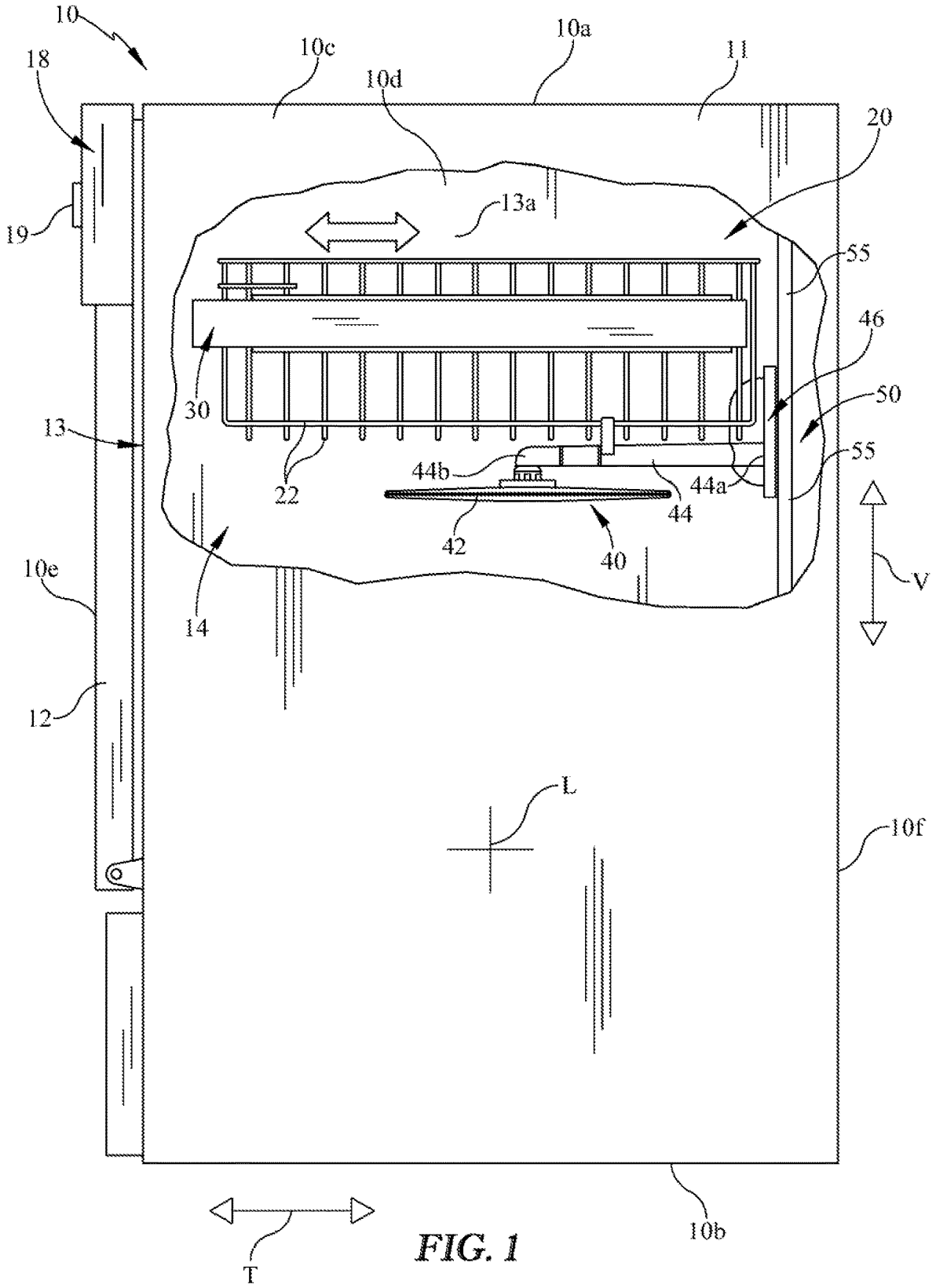
FIG. 1 is a side view of one embodiment of a dish washing appliance with portions thereof removed to illustrate one embodiment of an adjustable dispensing device in a retracted and operative position with a water supply within the wash chamber.
Figure 2:
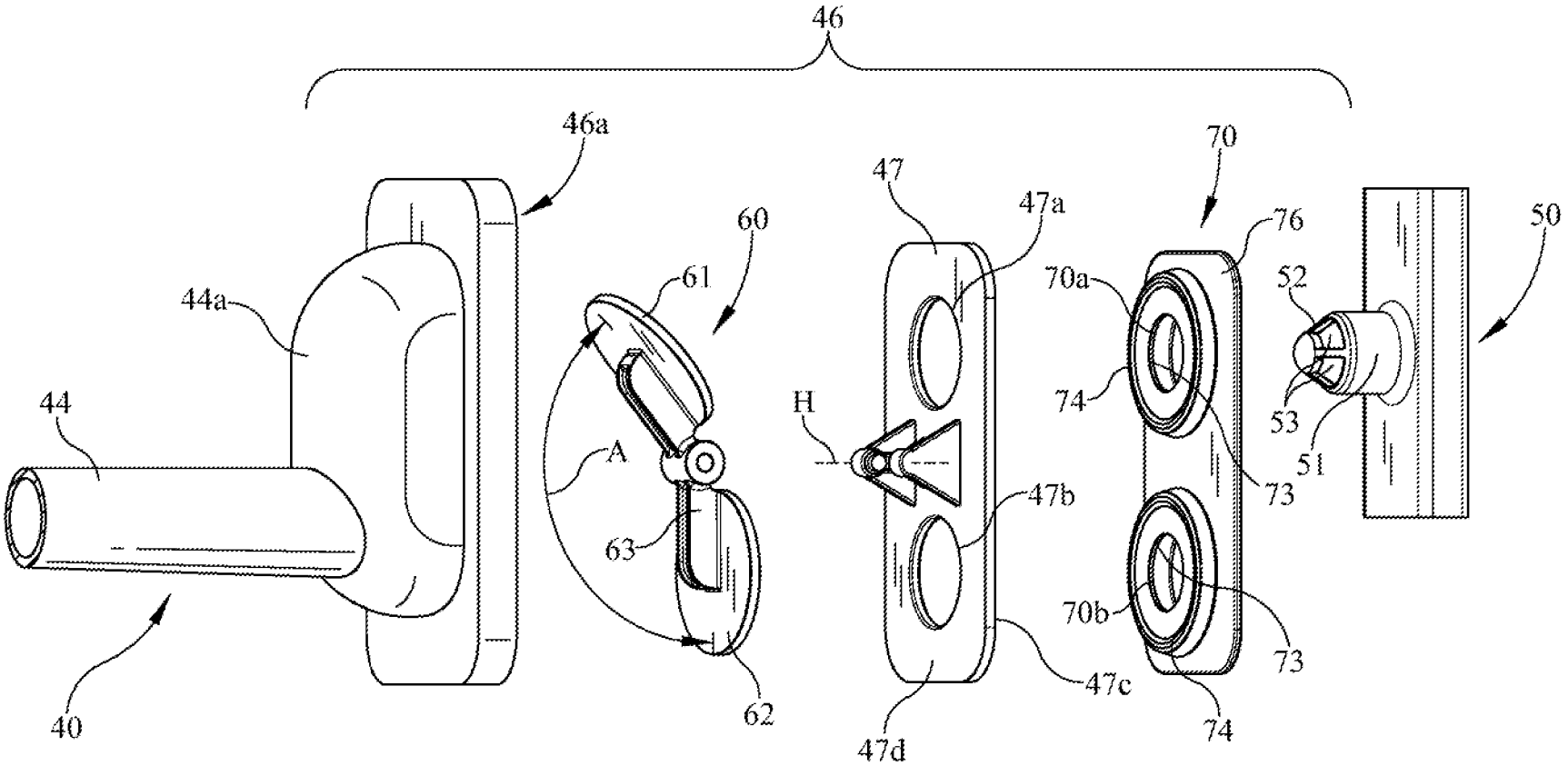
FIG. 2 is an enlarged exploded view of the embodiment of the docking port arrangement of FIG. 1 away from a portion of the docking station.

Numerous variations and modifications will be apparent to one of ordinary skill in the art, as will become apparent from the description below. Therefore, the invention is not limited to the specific implementations discussed herein.

The embodiments discussed hereinafter will focus on the implementation of the hereinafter-described apparatus and techniques within a front-load residential dish washing machine such as dish washing appliance 10, such as the type that may be used in single-family or multi-family dwellings, or in other similar applications. However, it will be appreciated that the herein-described apparatus and techniques may also be used in connection with other types of dish washing machines in some embodiments. For example, the herein-described apparatus and techniques may be used in commercial applications in some embodiments. Moreover, the herein-described apparatus and techniques may be used in connection with other appliances, such as, for example, ovens, refrigerators, and the like. For example, one or more drawers, water dispenser, ice dispenser, etc. for a refrigerator appliance may include the apparatus and techniques described herein may be implemented.

Embodiments for a dish washing machine are shown herein for ease of understanding. For example, a front-load dish washing machine that includes a front-mounted door 12 in a cabinet or housing 11 that provides access to one or more horizontally-oriented dishwasher racks 20 housed within the cabinet or housing 11 may be used. More specifically, the dishwasher rack 20 may be housed in a dishwasher tub or wash chamber 14. Implementation of the herein-described apparatus and techniques within a variety of appliances would be well within the abilities of one of ordinary skill in the art having the benefit of the instant disclosure, so the invention is not limited to the front-load dish washing implementation discussed further herein. For example, the apparatus and techniques may be used with a dishwasher drawer and/or basket of a dish washing appliance.

Turning now to the drawings, wherein like numbers denote like parts throughout the several views, FIG. 1 illustrates an example dish washing appliance 10 in which the various technologies and techniques described herein may be implemented. Dish washing appliance 10 is a front-load dish washing machine, and as such may include a front-mounted door 12 defining an opening 13 that provides access to a horizontally-oriented dishwasher tub 14. The door 12 may be coupled with a cabinet or housing 11 that may house the dishwasher tub or wash chamber 14 in some embodiments. Door 12 is generally hinged along a front or front edge of the housing 11 adjacent the opening 13 and is pivotable between the open position (not shown) and a closed position illustrated in FIG. 1. When door 12 is in the open position, dishes, utensils, pans, and other washable items may be inserted into and removed from the one or more dishwasher racks 20 in an extended position (e.g. loading), different from a retracted position (e.g. washing/operative), through the opening 13 in the front of cabinet or housing 11. Control over dish washing appliance 10 by a user is generally managed through a control panel 18 disposed on a door 12 and implementing a user interface 19, and it will be appreciated that in different dish washing machine designs, control panel 18 may include various types of input and/or output devices, including various knobs, buttons, lights, switches, textual and/or graphical displays, touch screens, etc. through which a user may configure one or more settings and start and stop one or more dishwasher cycles.

Dish washing appliance 10 defines a vertical direction V, a lateral direction L, and a transverse direction T. As may be seen in FIG. 1, dish washing appliance 10 extends between a top 10*a* and a bottom 10*b* along vertical direction V and also extends between a first side 10*c* and a second side 10*c* along lateral direction L. As may be seen in FIG. 1, dish washing appliance 10 also extends between a front 10*e* and a back 10*f* along transverse direction T. Vertical direction V, lateral direction L, and transverse direction T are mutually perpendicular and form an orthogonal directional system.

Slide assemblies 30 are mounted on opposing tub side walls 13*a* to support and provide for movement for a rack 20 (e.g. upper rack). Although not shown, it should be understood that a lower rack or other racks, etc. at a variety of elevations and/or positions may be used in embodiments. The upper rack 20 may be fabricated into lattice structures including a plurality of elongated members 22 that extend in lateral L, transverse T, and/or vertical V directions. Each rack 20 may be adapted for movement between an extended or loading position (not shown) in which the rack is substantially positioned outside the wash chamber 14, and a retracted or operative position (shown in FIG. 1) in which the rack 20 is located inside the wash chamber 14 and in fluid communication with a docking station 50. This is facilitated by slide assembly 30 or other devices that carry rack 20.

Dish washing appliance 10 further includes an adjustable spray arm assembly 40 that is rotatably mounted within the wash chamber 14 so as to rotate in relatively close proximity to the rack 20. Adjustable spray arm assembly 40 is fed by a fluid circulation assembly (not shown) for circulating pressurized water and/or dish washing fluid in wash chamber 14.

In some implementations, the spray arm assembly may be attached to upper rack 20 by any suitable means (e.g. snaps or clips). The spray arm assembly 40 is configured for receiving or engaging the docking station 50 when upper rack 20 is in a retracted position as shown in FIGS. 1 and 3-5. Docking station 50 is in fluid connection with fluid circulation assembly, which may supply docking station 50 with the pressurized water and/or dish washing fluid during one or more dish washing cycles. Additionally, an upper spray or upper spray arm assembly (not shown) may be located above the upper rack 20. The dispensing device 42 of the spray arm assembly 40 may be a variety of constructions, quantities, sizes, shapes, and positions within one or more zones or areas of the dishwasher. For example, although the dispensing device 42 is shown as a rotating spray arm, the dispensing device may include or be in combination with wall mounted sprayers, rack-mounted sprayers, oscillating sprayers, fixed sprayers, rotating sprayers, focused sprayers/nozzles, etc. The dispensing device 42 may be in downstream communication to a downstream end 44*b* of one or more conduits 44 and dockable via a dock 46 at an upstream end 44*a* of the conduit(s) to the docking station 50 in fluid communication with a supply conduit 55. In some embodiments as shown in FIG. 1, the conduit 44 is mounted on the rack 20 and includes the upstream end 44*a* and an opposing downstream end 44*b* (e.g. adjacent the back side of the wash chamber 14). Any number, size, shape, construction, or position of the conduit 44 may be used and still be within the scope of the invention. For example, the conduit may be a hose or tubing. Fluid supplied to the dispensing device may be a liquid and/or gas (e.g. air).

In some implementations of the dish washing appliance 10 provided by FIG. 1, the rack 20 includes slides 30 and/or mounting structure to allow engaging and/or disengagement of the dock 46 with the docking station 50. The slide and/or mounts allow for rack 20 to adjust to one or more different positions in vertical upward or downward directions V. As a result, the spray arm assembly 40 may be capable of receiving docking station 50 at two or more different elevations. The spray arm assembly 40 may be provided with the dock 46, positioned at the upstream end 44*a* of conduit 44, capable of receiving docking station 50 at two different elevations. A variety of means for adjusting the rack 20 and/or spray arm assembly 40 in a variety of ways, orientations, and directions, etc. may be provided.

Figure 3:
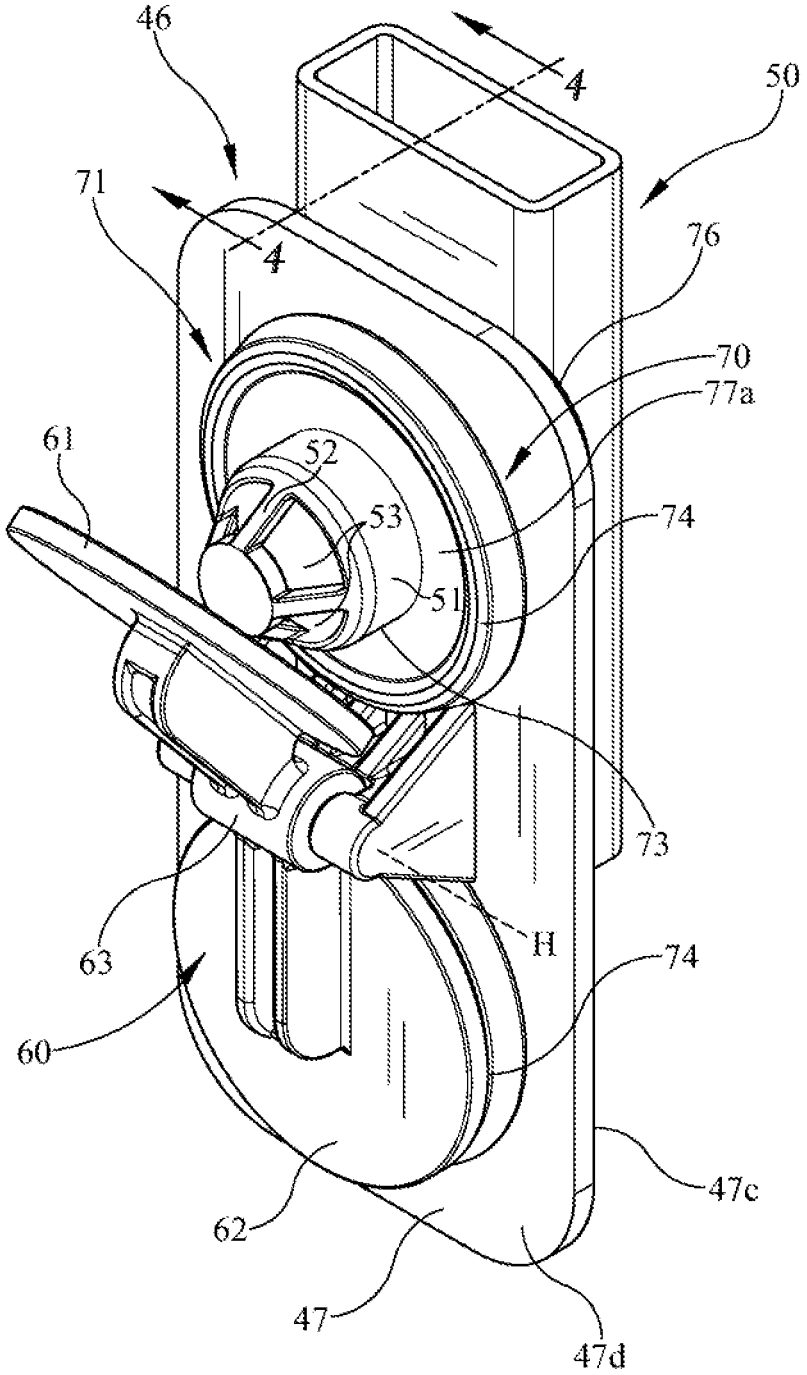
FIG. 3 is an enlarged perspective view of the docking port arrangement of FIG. 1 in the operative position with a portion of the docking station.
Figure 4:
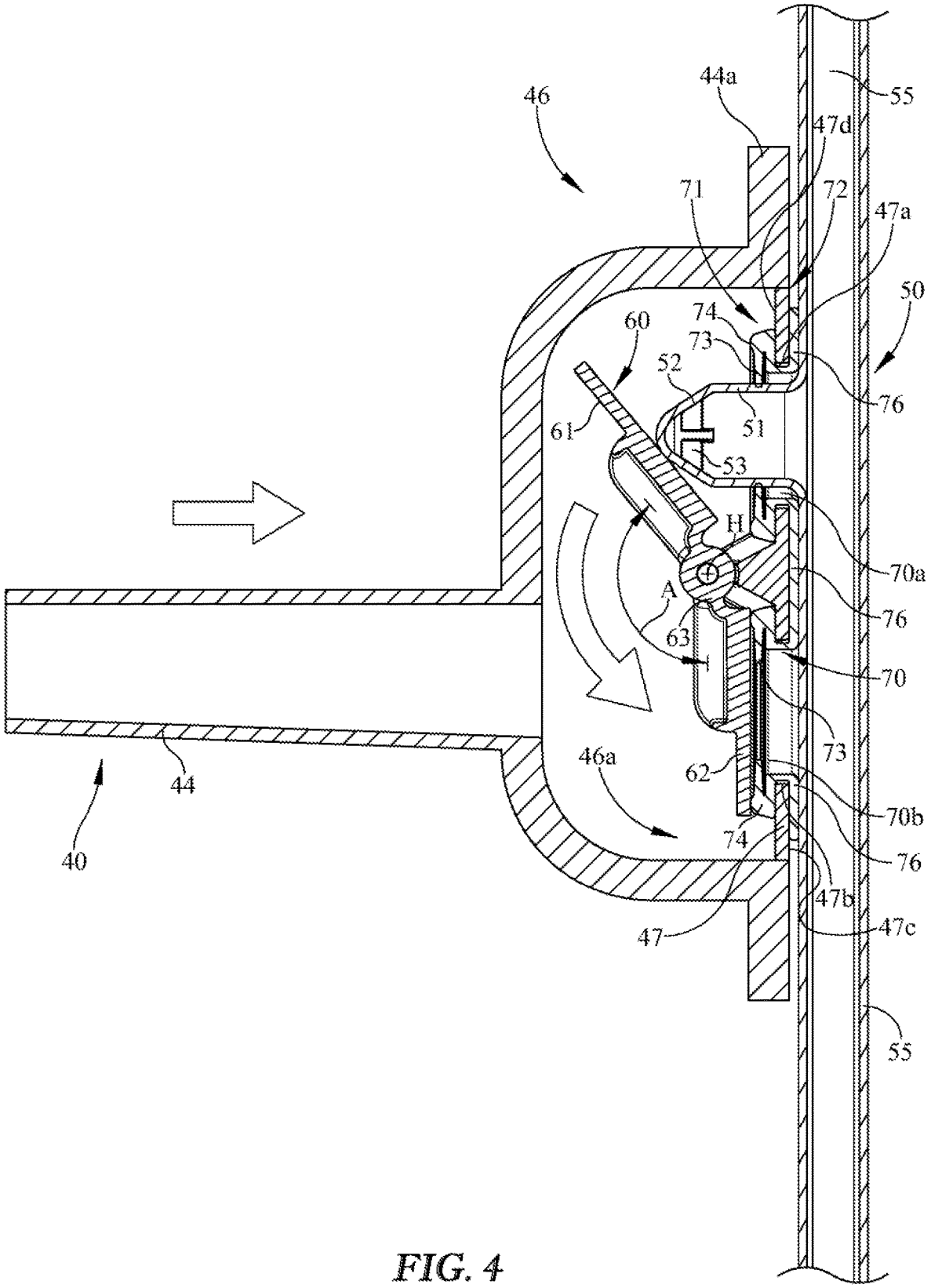
FIG. 4 is a sectional view of FIG. 3 taken along line 4-4.
Figure 5:
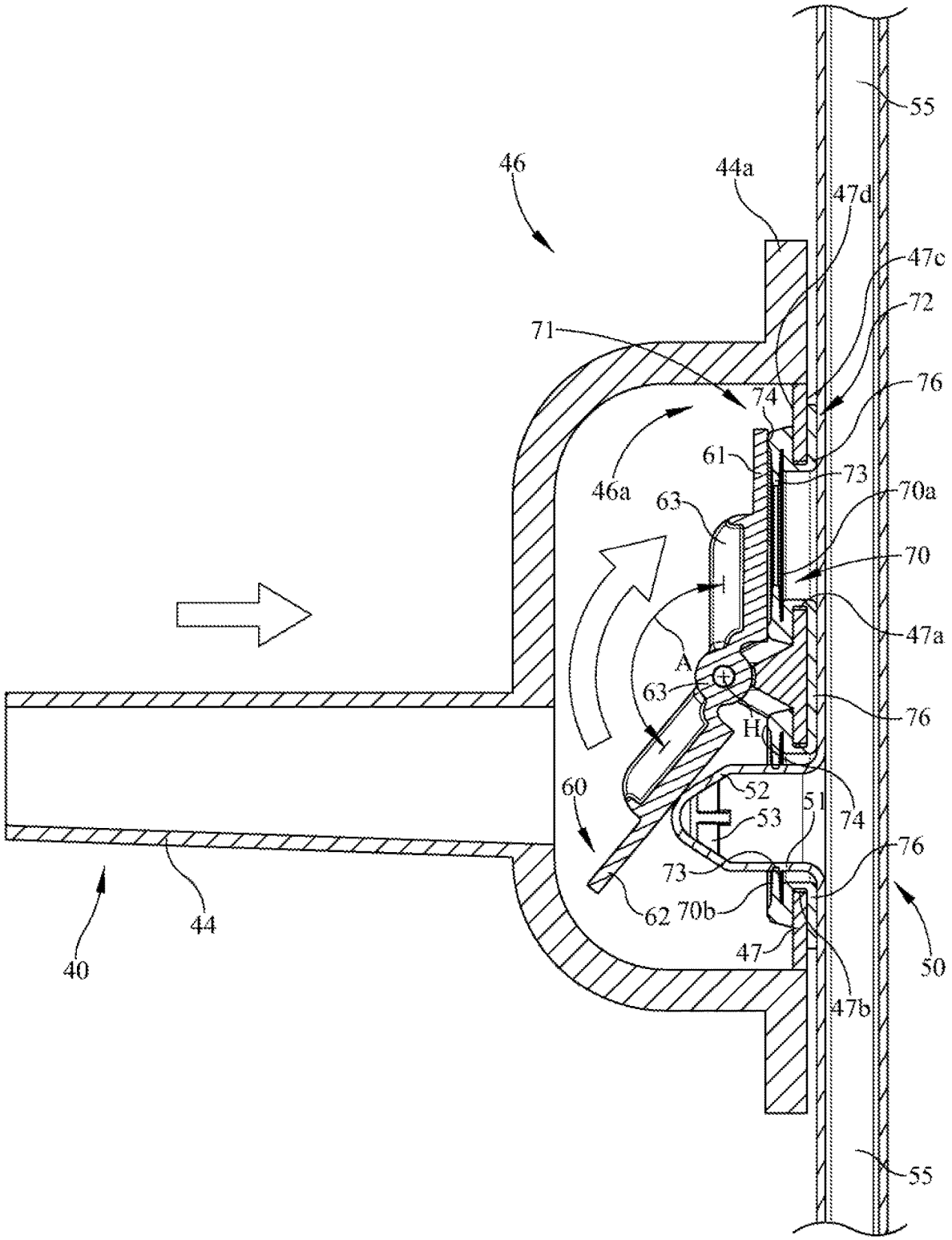
FIG. 5 is a sectional view of FIG. 3 taken along line 4-4 with the dispensing device adjusted (e.g. vertically downward or upward) to another operative position.

Referring now to FIGS. 2-5, one embodiment of the spray arm assembly 40 and/or dock 46 adjacent the docking station 50 is shown. The interior of the conduit 44 at the upstream end 44*a* includes a check valve plate 47 of the dock 46. Conduit upstream end 44*a* includes an opening 46*a*, wherein the check valve plate 47 is positioned adjacent the opening 46*a*. In some embodiments, the check valve plate 47 may be positioned within the opening 46*a* of the conduit 44 and secured by any suitable means (e.g. snaps, clips, etc.). For example, check valve plate 47 may be attach to the conduit opening 46*a* by adhesive. As shown, check valve plate 47 defines an upper aperture 47*a* and a lower aperture 47*b*, with lower aperture 47*b* being positioned below upper aperture 47*a* in vertical direction V. Spray arm assembly 40 or dock 46 further includes one or more check valves 60. In the embodiment shown, the check valve 60 may include an upper check valve 61 and a lower check valve 62 fixed on opposing ends of a rocker arm or member 63. The upper check valve 61 and lower check valve 62 pivot together about a hinge or axis H. As shown, the upper check valve 61 and the lower check valve 62 are position at a fixed angle A relative to each other during the pivoting between the corresponding open or closed positions. The check valve 60 or arm 63, between the upper and lower check valves, is pivotably connected to the check valve plate 47. The arm 63 may be pivotably coupled to the check valve plate 47 between the apertures 47*a* and 47*b*. As a result, the upper check valve 61 is in the opposite position (e.g. open or closed) that the lower check valve 62 is in relative to the corresponding aperture. Upper check valve 61 pivots or hinges between an open position as shown in FIGS. 3 and 4 and a closed position as shown in FIG. 5. Correspondingly, lower check valve 62 pivots or hinges between an open position as shown in FIG. 5 and a closed position as shown in FIGS. 3 and 4. When upper check valve 61 is in the closed position, it forms a fluid seal between conduit 44 and upper aperture 47*a*. Likewise, when lower check valve 62 is in the closed position, it forms a fluid seal between conduit 44 and lower aperture 47*b*. It should be understood that the check valve or portions thereof may be a variety of constructions, quantities, shapes, and sizes and still be within the scope of the invention. For example, the upper and lower check valves may pivot independently of each other or not be fixed together as shown in some embodiments.

As shown in FIGS. 2-5, spray arm assembly 40 further includes one or more gaskets 70 positioned adjacent to check valve plate 47. Gasket 70 may be made of a suitable resilient material, such as a natural or synthetic rubber (e.g. silicone, etc.). In the embodiment shown, gasket 70 includes an upper aperture 70*a* and a lower aperture 70*b*. Upper and lower apertures 70*a*, 70*b* in gasket 70 are configured such that when gasket 70 is positioned adjacent to check valve plate 47, upper aperture 47*a* aligns with upper aperture 70*a*, and lower aperture 47*b* aligns with lower aperture 70*b*. Moreover, the gasket 70 may include an interior portion 71 within or facing the interior of the conduit 44 or opening 46*a*. The interior portion 71 of the gasket 70 may include one or more flanges or lips adjacent the upper/lower apertures 70*a*, 70*b*. The one or more flanges may surround and/or be concentric with upper/lower apertures 70*a*, 70*b*. One or more flanges 73 may project inwardly or radially into upper and lower apertures 47*a*, 47*b*, respectively, in check valve plate 47. Another one or more flanges or projection 74 may project (e.g. transverse to the flange) outwardly or interiorly towards the check valves 60 (e.g. 61 and/or 62).

In some implementations, the gasket 70 may include one or more abutment members or pads 76. The abutment members 76 may allow for an abutting engagement with the docking station 50, upstream water supply conduit 55, and/or one or more portions of the wash chamber/appliance. The abutment members 76 of the gasket 70 may comprise a portion of an outer periphery or surfaces of the spray arm assembly. The outer periphery of the spray arm assembly 40 that may include the abutment members 76 contact or engage the docking station 50 or other portions of the dishwasher when adjusting the assembly 40 and/or rack from the extended position towards the retracted or operative position. The abutment members 76 are positioned at the leading or contact surface of the spray arm assembly in the direction of retraction or travel. The abutment members 76 may dampen the noise and/or forces felt by the user when retracting and/or extending the rack 20 and/or assembly 40 into and/or out of the operative position.

The gasket 70 may be disposed one or more surfaces of the check valve plate 47. The abutment members 76 may be disposed on at least an exterior surface 47*c* of the check valve plate 47. The interior surface 47*d* of the check valve plate may face in the direction of the opening 46*a* and/or interior of the conduit 44 and the exterior surface 47*c* of the check valve plate 47 may extend outwardly from the spray arm assembly 40. In some embodiments as shown, the gasket 70 may extend along the interior surface 47*d* of the check valve plate 47, through at least one of the apertures 47*a*, 47*b*, and/or along the exterior surface 47*c* of the check valve plate 47. A portion of the gasket 70 extending along the exterior surface 47*c* of the check valve plate 47 may include the one or more abutment members 76. The gasket may extend through one or more apertures (e.g. 47*a*, 47*b*, or both) in some embodiments. For example, the gasket may extend through both apertures 47*a* and 47*b* as shown in the embodiment. Further, for example, the gasket 70 may extend through the plate and/or around the outer periphery of the plate between the interior surface 47*d* and the exterior surface 47*c*, instead of or in combination with, through one or more apertures 47*a* and/or 47*b*. Moreover, in some embodiments, the gasket 70 may extend along the outer periphery of the check valve plate 47 between the interior surface 47*d* and the exterior surface 47*c*. It should be understood that the abutment members 76 may be separate from the flanges 73, 74 (e.g. two or more piece construction) between two or more portions of the gasket. For example, the abutment members may be positioned on the exterior surface 47*c* separate from the aperture seals or flanges. In some embodiments, the one or more abutment members may be in a plane transverse (e.g. perpendicular) to the direction of travel of the rack 20 and/or spray arm assembly 40. Although it is shown that the abutment members releasably engage the upstream docking station and/or water supply conduit, other portions of the rack 20 and/or spray arm assembly 40 may releasably contact or stop the retraction travel in combination with the abutment members in various embodiments. As is shown, more clearly in FIGS. 3-5, the one or more abutment members 76 may contact both the check valve plate 47 and the docking station 50 and/or water supply conduit 55. Other embodiments of the abutment members 76 may contact a variety of structure within the appliance 10 (e.g. one or more surfaces of the interior of the wash chamber 14). Although the abutment members are shown as a substantially planar member, it should be understood that the abutment members may be a variety of shapes, sizes, quantities, constructions, and positions on the spray arm assembly and still be within the scope of the invention. For example, the abutment members may be a plurality of projections (e.g. connected or disconnected from each other) and may extend in the direction of the retraction.

The dampening of the releasable fluid engagement of the spray arm assembly 40 to the docking station 50 may occur at each of the varying heights or adjustable positions. The gasket 70 or portions thereof abut the docking station 50 or other structure of the dish washing appliance impeding further movement when retracting the adjustable spray arm assembly from the extend position to the operative position. The gasket 70 seals the fluid communication between the docking station 50 and the dock 46 as well as substantially stops or abuts the docking station to impede travel to the operative position. In some embodiments, the one or more abutment members 76 may make first contact with structure during, before, or after the gasket flanges 73, 74 seal against their respective second contact location or structure (e.g. base protrusion 51 and/or upper and lower check valve) when opening or closing the apertures of 47*a*, 47*b* of the check valve plate. The abutment members 76 or gasket 70 traveling with the spray arm assembly 40 may be out of engagement with the docking station when extending the adjustable spray arm from the operative position (FIG. 1) to the extended position.

Docking station 50 may deliver pressurized fluid to one or more spray arm assemblies 40 when received within upper or lower apertures 47*a*, 47*b*. Docking station 50 includes a base protrusion 51 and a conical protrusion 52. Conical protrusion 52, is configured for aligning and/or guiding docking station 50 into upper or lower apertures 47*a*, 47*b* of check valve plate 47. Additionally, conical protrusion 52 includes a plurality of openings 53 to facilitate the flow of pressurized fluid. It should be understood that the docking station 50 may have any other suitable configuration for guiding docking station 50 into upper or lower apertures 47*a*, 47*b* of check valve plate 47 and delivering pressurized fluid.

Referring now to FIGS. 3 and 4, one implementation of an spray arm assembly 40 may receive protrusion 51 and/or 52 of docking station 50 into upper aperture 47*a* of check valve plate 47 when in the retracted/operative position. As shown in FIG. 5, at another vertical position, the spray arm assembly 40 may receive protrusions 51 and/or 52 of docking station 50 into lower aperture 47*b* of check valve plate 47. Upper aperture 47*a* and lower aperture 47*b* in check valve plate 47 are each configured for receiving conical protrusion 52 and/or base protrusion 51 of docking station 50. The base protrusion 51 of docking station 50 has a cross-sectional shape in vertical direction V and lateral direction L that may be complementary with both upper aperture 47*a* and lower aperture 47*b*. Additionally, conical protrusion 52 and base protrusion 51 extend in the transverse direction T. Conical protrusion 52 has a conical shape that acts as a guidance structure when docking station 50 is being received within upper or lower apertures 47*a*, 47*b*. The gasket 70 (e.g. flange 73 on the upper aperture 70*a* or lower aperture 70*b*) seals on the respective portion of base protrusion 51 in the operative position.

Spray arm assembly's 40 ability to selectively receive docking station 50 at two or more different heights is demonstrated by FIGS. 4 and 5. When, for example, docking station 50 is received within lower aperture 47*b* of check valve plate 47 (FIG. 5), lower check valve 62 is moved to the open position. When lower check valve 62 is moving towards the open position, fixed arm 63 and/or upper check valve 61 pivot towards a closed position sealing against flange 74, as shown in FIG. 5. Docking station 50 may then deliver pressurized fluid to the conduit 44. Alternatively, docking station 50 may be received within upper aperture 47*a* (FIGS. 3 and 4). In this instance, protrusions 51 and/or 52 may pivot the upper check valve 61 into the open position, and lower check valve 62 correspondingly pivots to the closed position. A fluid seal is created between the lower check valve 62 and the gasket 70 (e.g. flange 74) when the lower check valve is in the closed position.

While several embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the teachings is/are used. Those skilled in the art will recognize, or be able to ascertain using no more than routine experimentation, many equivalents to the specific embodiments described herein. It is, therefore, to be understood that the foregoing embodiments are presented by way of example only and that, within the scope of the appended claims and equivalents thereto, embodiments may be practiced otherwise than as specifically described and claimed. Embodiments of the present disclosure are directed to each individual feature, system, article, material, and/or method described herein. In addition, any combination of two or more such features, systems, articles, materials, and/or methods, if such features, systems, articles, materials, and/or methods are not mutually inconsistent, is included within the scope of the present disclosure.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

It should also be understood that, unless clearly indicated to the contrary, in any methods claimed herein that include more than one step or act, the order of the steps or acts of the method is not necessarily limited to the order in which the steps or acts of the method are recited.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures, Section 2111.03.

It is to be understood that the embodiments are not limited in its application to the details of construction and the arrangement of components set forth in the description or illustrated in the drawings. The invention is capable of other embodiments and of being practiced or of being carried out in various ways. Unless limited otherwise, the terms "connected," "coupled," "in communication with," and "mounted," and variations thereof herein are used broadly and encompass direct and indirect connections, couplings, and mountings. In addition, the terms "connected" and "coupled" and variations thereof are not restricted to physical or mechanical connections or couplings.

The foregoing description of several embodiments of the invention has been presented for purposes of illustration. It is not intended to be exhaustive or to limit the invention to the precise steps and/or forms disclosed, and obviously many modifications and variations are possible in light of the above teaching.

The invention claimed is:

1. An adjustable spray arm assembly comprising:

a conduit having an upstream end and a downstream end, wherein the upstream end defines an opening;

a dispensing device adjacent to and in fluid communication with the downstream end of the conduit;

a check valve plate positioned at the opening of the upstream end of the conduit, wherein the check valve plate includes an upper aperture, a lower aperture, and two or more check valves operable between a closed position and an open position with the upper aperture and the lower aperture;

a gasket having an upper aperture aligned with the upper aperture of the check valve plate and a lower aperture aligned with the lower aperture of the check valve plate, wherein the gasket includes one or more abutment members for an abutting engagement with an upstream docking station; and wherein the check valve plate includes an interior surface facing towards the opening of the upstream end and an opposing exterior surface, wherein the gasket extends along the interior surface, through at least one of the upper aperture and the lower aperture of the check valve plate, and the exterior surface.

2. The adjustable spray arm assembly of claim 1 wherein the gasket extending along the exterior surface includes the one or more abutment members.

3. The adjustable spray arm assembly of claim 1 wherein the two or more check valves include an upper check valve and a lower check valve pivotally connected to the check valve plate within the upstream end of the conduit.

4. The adjustable spray arm assembly of claim 3 wherein the upper check valve and the lower check valve are fixed at opposing ends of an arm, wherein the upper check valve and the lower check valve pivot together relative to the check valve plate.

5. The adjustable spray arm assembly of claim 1 further comprising an outer periphery, wherein the outer periphery includes the one or more abutment members of the gasket.

6. An adjustable spray arm assembly for use in a dish washing appliance comprising:

a wash chamber;

a water supply conduit in fluid communication with a docking station, wherein the docking station is positioned within the wash chamber;

an adjustable spray arm in fluid communication with the docking station in an retracted position and out of fluid communication with the docking station in an extended position; and wherein the adjustable spray arm comprises:

a conduit having an upstream end and a downstream end, wherein the upstream end defines an opening;

a dispensing device adjacent to and in fluid communication with the downstream end of the conduit;

a check valve plate positioned at the opening of the upstream end of the conduit, wherein the check valve plate includes an upper aperture, a lower aperture, and two or more check valves operable between a closed position and an open position with the upper aperture and the lower aperture, and wherein the upper aperture and the lower aperture are configured for selective receipt of the docking station when in the retracted position; and a gasket having an upper aperture aligned with the upper aperture of the check valve plate and a lower aperture aligned with the lower aperture of the check valve plate, wherein the gasket includes one or more abutment members in contact with at least one of the water supply conduit and the docking station when in the retracted position and out of contact with the at least one of the water supply conduit and the docking station when in the extended position.

7. The adjustable spray arm assembly for use in a dish washing appliance of claim 6 wherein the docking station includes a conical protrusion guiding the docking station into receipt of the upper aperture or the lower aperture of the check valve plate.

8. The adjustable spray arm assembly for use in a dish washing appliance of claim 7 wherein the one or more abutment members contact a remaining portion of the docking station outwardly from the conical protrusion.

9. The adjustable spray arm assembly for use in a dish washing appliance of claim 7 wherein the check valve plate includes an interior surface facing towards the opening of the upstream end and an opposing exterior surface, wherein the gasket extends along the interior surface, through at least one of the upper aperture and the lower aperture of the check valve plate, and the exterior surface.

10. The adjustable spray arm assembly for use in a dish washing appliance of claim 9 wherein the gasket extending along the exterior surface includes the one or more abutment members.

11. The adjustable spray arm assembly for use in a dish washing appliance of claim 7 wherein the two or more check valves include an upper check valve and a lower check valve pivotally connected to the check valve plate within the upstream end of the conduit, and wherein the upper check valve and the lower check valve are fixed at opposing ends of an arm, wherein the upper check valve and the lower check valve pivot together relative to the check valve plate.

12. The adjustable spray arm assembly for use in a dish washing appliance of claim 7 wherein the gasket is made of silicone.

13. The adjustable spray arm assembly for use in a dish washing appliance of claim 7 wherein the dispensing device is a rotating spray arm.

14. An adjustable spray arm assembly comprising:

a conduit having an upstream end and a downstream end, wherein the upstream end defines an opening;

a dispensing device adjacent to and in fluid communication with the downstream end of the conduit;

a check valve plate positioned at the opening of the upstream end of the conduit, wherein the check valve plate includes an upper aperture, a lower aperture, and two or more check valves operable between a closed position and an open position with the upper aperture and the lower aperture;

a gasket having an upper aperture aligned with the upper aperture of the check valve plate and a lower aperture aligned with the lower aperture of the check valve plate, wherein the gasket includes one or more abutment members for an abutting engagement with an upstream docking station;

wherein the two or more check valves include an upper check valve and a lower check valve pivotally connected to the check valve plate within the upstream end of the conduit; and wherein the upper check valve and the lower check valve are fixed at opposing ends of an arm, wherein the upper check valve and the lower check valve pivot together relative to the check valve plate.

15. The adjustable spray arm assembly of claim 14 further comprising an outer periphery, wherein the outer periphery includes the one or more abutment members of the gasket.

16. The adjustable spray arm assembly of claim 14 wherein the check valve plate includes an interior surface facing towards the opening of the upstream end and an opposing exterior surface, wherein the gasket extends along the interior surface, through at least one of the upper aperture and the lower aperture of the check valve plate, and the exterior surface; and wherein the gasket extending along the exterior surface includes the one or more abutment members.

* * * * *